United States Patent [19]

Schmidt

[11] 4,221,969

[45] Sep. 9, 1980

[54] X-RAY VOLTAGE SUPPLY

[75] Inventor: Manfred Schmidt, Karlsruhe, Fed. Rep. of Germany

[73] Assignee: Sybron Corporation, Rochester, N.Y.

[21] Appl. No.: 973,080

[22] Filed: Dec. 26, 1978

[30] Foreign Application Priority Data

Dec. 5, 1978 [DE] Fed. Rep. of Germany ..... 2820773

[51] Int. Cl.[2] ..... H05G 1/14; H05G 1/56

[52] U.S. Cl. ..... 250/421; 250/402; 250/413; 315/102; 315/278

[58] Field of Search ..... 250/401, 402, 409, 410, 250/413, 417, 421; 315/102, 105, 277, 278, 291, 362

[56] References Cited

U.S. PATENT DOCUMENTS 4,117,334 9/1978 Strauts ..... 250/402

FOREIGN PATENT DOCUMENTS 1181828 11/1964 Fed. Rep. of Germany ..... 250/409

*Primary Examiner*—Eugene R. LaRoche

*Attorney, Agent, or Firm*—Theodore B. Roessel; J. Stephen Yeo

[57] ABSTRACT

A voltage supply for an X-ray tube provides both high and low voltages to the tube. A high voltage transformer using split primary and secondary windings is employed. The high voltage is switched on and off by selectively phasing the voltage across the transformer's secondary coils. Low voltage is coupled from one of two primary windings.

2 Claims, 1 Drawing Figure

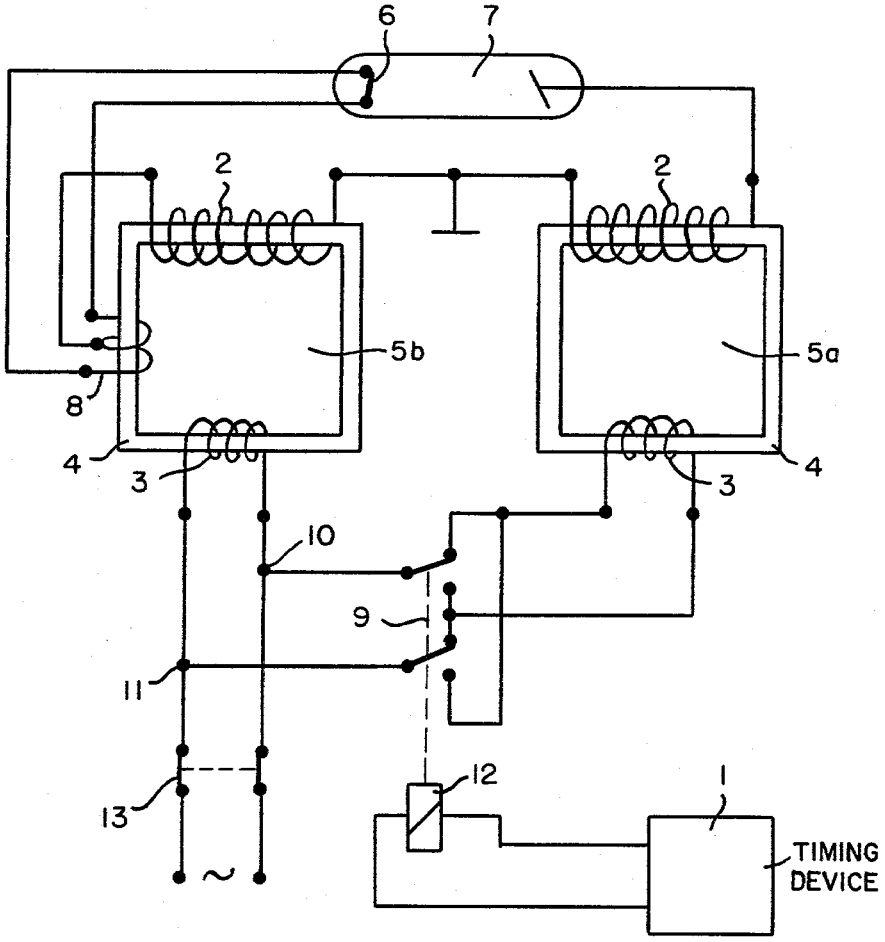
6
7
2
2
5b
5a
8
4
3
3
4
10
9
11
12
1
13
TIMING
DEVICE

X-RAY VOLTAGE SUPPLY

BACKGROUND OF THE INVENTION

This invention pertains to X-ray apparatus and is more particularly concerned with X-ray apparatus having high voltage control means.

A conventional X-ray tube has an anode target and a heated cathode. When high voltage is applied across the anode and cathode, electrons are emitted from the cathode and strike the anode with sufficient energy for the anode to emit X-rays. The energy of X-rays is dependent upon both the magnitude of the high voltage and the temperature of the cathode.

The high voltage is often supplied by a high voltage transformer while the cathode is heated by current supplied by a low voltage transformer. In some X-ray apparatus, the transformers are mounted together with the X-ray tube within a common housing. To reduce size and costs, it is sometimes the practice to wind both the high voltage windings and the low voltage windings on the same core. Both sets of secondary windings are coupled to a common primary winding which is energized by line voltage. This arrangement prevents the insulation problems known to occur when separate high and low voltage transformers are used, and allows the dimensions of the apparatus to be kept small, which is a desirable feature for dental practice.

With this arrangement, the tube is immediately under high voltage when the line supply is switched on, however, the emission of image forming radiation from the tube is retarded because of thermal inertia of the cathode. Consequently, radiation is emitted before the optimum radiation intensity required for the operation of the unit is built up. The undesirable result of this is an increase in the exposure to soft radiation which is not effective enough to form an image on X-ray film.

Because of the delay between the application of high voltage and the optimum image forming radiation, some known units include means for counting exposure time only after a certain radiation level is reached. While this method does yield reproducible results in the exposure of X-ray film, there remains the undesirable irradiation of the patient during the interval from which the high voltage is first applied to the tube until the start of exposure time. This interval will be called the cathode preheat time.

Accordingly, our object of this invention is to provide an X-ray apparatus eliminating the effects of radiation on both film exposure and the patient during the preheat time.

SUMMARY OF THE INVENTION

An X-ray tube power supply provides high voltage to the tube from a high voltage transformer. The high voltage transformer has two secondary coils and two primary coils. One of each type of coil is wound about one of two cores. One core also has a low voltage secondary winding. High voltage across the two high voltage coils is phased to be selectively additive or canceling. In one embodiment the phasing is accomplished by selectively interconnecting the the primary windings.

DESCRIPTION OF THE DRAWINGS

The single drawing is a schematic representation of X-ray apparatus embodying the invention.

PREFERRED EMBODIMENT OF THE INVENTION

Referring to the drawing, there is seen an X-ray tube 7 and a voltage supply which embodies the invention. Identical components will be identified by the same reference numerals.

Voltages are supplied to the tube 7 from the output of high and low voltages transformers. The secondary winding of the high voltage transformer is divided into two identical coils 2, arranged on separate identical cores 4, and connected in series. The primary winding also has two identical coils 3 arranged upon cores 4, so as to associate with the secondary coils 2.

Each combination of a secondary coil 2, a primary coil 3, and a core 4 is a separate magnetic circuit, *5a* and *5b*. One secondary coil is connected to the X-ray tube's anode. The other secondary coil is connected to the cathode 6. The core which carries the secondary coil that is connected to the cathode 6 also carries a low voltage secondary winding, 8, for the heating the cathode.

As a feature of the invention, the primary coil of magnetic circuit *5a* is connected with the primary coil of magnetic circuit *5b* by means of a selector switch 9. The junctions, 10, 11 of the two primary coils are energized by line voltage, from which the apparatus may be isolated by means of line voltage switch 13.

The selector switch 9 may be part of a mechanical switching relay 12, as illustrated, or, alternatively, a semiconductor, tube, o equivalent device may be used. The selector switch 9 is controlled by a timing device, 1, which may be any type, including mechanical, electromechanical, and electronic.

The operation of the described embodiment is based on the fact that in one switching state, the high voltages across the two coils of the secondary winding are cancelled, and in the other switching state they are additive. However, in both switching states, the low voltage is maintained across the heating filament of the cathode. In this way, the X-ray tube has only two operating states, zero emission and maximum emission. The change over from one state to the other is preferably accomplished by changing the polarity of the primary coil of one of the two magnetic circuits *5a* and *5b* by selector switch 9.

In the embodiment shown, the position of the selector switch 9 is actuated by relay 12. The excitation state of relay 12 is controlled by switching signals from the output of timing device 1.

Referring to the drawing, selector switch 9 is shown in a position, corresponding to a switch-off signal, which interconnects the primary coils 3 so to cause a 180° phase relation between the voltages on the primary coils 3. As a result, the high voltage secondary coils will also have their voltages 180° out of phase. The secondary voltages mutually concel each other so that the anode and cathode will be at the same potential, and no radiation will emit from the tube. At the same time, a low voltage is available from winding 8 to heat the cathode.

No X-ray emission will occur until the phase relation is reversed. In response to a switch on signal from timing device 1, switch 9 changes the connections between coils 3 so as to cause the voltages across coils 3 and 2 to be in phase and additive. The low voltage from winding 8 will still heat the cathode and tube will emit the maximum radiation characteristic for the apparatus.

There are only two operating conditions of the X-ray tube, zero emission and maximum emission. No intermediary values need be considered on account of the thermal inertia because the low voltages which heats the cathode is on during both operating conditions. Consequently, the irradiation of the patient which would otherwise occur with intermediary emission values, will be eliminated.

Apparatus according to the invention will thus offer the same advantages of apparatus having a separate low voltage transformer and preheats circuit.

We claim:

1. An X-ray voltage supply for providing a high cathode to anode and a low cathode heating voltage to an X-ray tube having a cathode and anode, said voltage supply comprised of:

a high voltage transformer having a high voltage secondary winding and a primary winding;

said secondary winding divided into two secondary coils, one coil connected to the anode and the other coil connected to the cathode;

said primary winding divided into two primary coils, a first and second core, each core forming a magnetic circuit with one of said secondary coils and one of said primary coils;

timing means for providing a switch-off signal and a switch-on signal;

phasing means for selectively phasing the voltages across the secondary coils so that in response to a switch off signal, the secondary voltages are 180° out of phase, canceling each other so that no high voltage appears between cathode and anode of the tube, resulting in no X-ray emission, and in response to a switch-on signal, said voltages are in phase and additive across cathode and anode, resulting in X-ray emission;

a low voltage secondary winding associated with the same core as the secondary high voltage coil connected to the cathode, for providing low voltage to heat the cathode during both phase relationships.

2. The X-ray voltage supply of claim 1 wherein said phasing means is a switch selectively interconnecting said primary coils in response to said signals.

* * * * *